United States Patent [19]

Derby

[11] Patent Number: 5,056,571

[45] Date of Patent: Oct. 15, 1991

[54] CONTAINER FILL SYSTEM

[75] Inventor: Norwin C. Derby, Sherman, Tex.

[73] Assignee: Super Sack Manufacturing Company, Dallas, Tex.

[21] Appl. No.: 662,020

[22] Filed: Feb. 28, 1991

Related U.S. Application Data

[63] Continuation of Ser. No. 364,315, Jun. 12, 1989, abandoned.

[51] Int. Cl.[5] ..... B65B 3/16; B65B 1/04

[52] U.S. Cl. ..... 141/114; 141/83; 141/10; 141/93; 141/314

[58] Field of Search ..... 141/83, 114, 10, 93, 141/59, 313, 314, 317; 248/100, 101, 95, 99

[56] References Cited

U.S. PATENT DOCUMENTS

| | | | |
|---|---|---|---|
| 2,235,942 | 3/1941 | Moore | 141/314 |
| 3,590,888 | 7/1971 | Coleman | 141/313 |
| 4,054,161 | 10/1977 | Alack | 141/93 |
| 4,056,130 | 11/1977 | Kens et al. | 141/314 |
| 4,182,386 | 1/1980 | Alack | 141/83 |
| 4,676,284 | 6/1987 | DeCrane | 141/114 |
| 4,688,371 | 8/1987 | Hecht | 141/83 |
| 4,782,865 | 11/1988 | Everman | 141/83 |
| 4,804,024 | 2/1989 | Arnemann | 141/83 |
| 4,854,353 | 8/1989 | Russell | 141/83 |

*Primary Examiner*—Henry J. Recla
*Assistant Examiner*—Keith Kupferschmid
*Attorney, Agent, or Firm*—Michael A. O'Neil

[57] ABSTRACT

A container fill system for filling flexible bulk containers having lift straps with a product having a support frame with first and second ends, a scale connected to the first end of the support frame for determining the weight of the flexible bulk containers, a fill control device connected to the second end of the support frame for controlling the flow rate of the product into the flexible bulk container, a rotatable holder connected to the support frame and to a fill spout rotatable along a vertical axis and having fingers for securing the lift straps to the rotatable holder for supporting the flexible bulk containers and an electronic operator panel with an associated microprocessor for controlling the operation of the container fill system. The container fill system of the present invention allows for one man operation and filling of the flexible bulk containers.

18 Claims, 7 Drawing Sheets

CONTAINER FILL SYSTEM

This application is a continuation of application Ser. No. 364,315 filed June 12, 1989, now abandoned.

TECHNICAL FIELD

This invention relates to a container fill system for filling flexible bulk containers with product and in particular relates to a container fill system having a rotatable holder for supporting a flexible bulk container.

BACKGROUND OF THE INVENTION

Flexible bulk containers for use in the storage, transportation and dispensation of flowable materials such as grains, chemicals and other bulky substances, are well known in the art as disclosed in U.S. Pat. Nos. 4,143,796 and 4,194,652. Although there have been container fill systems for use with flexible bulk containers for as long as such containers have existed, prior systems have been costly, inefficient, labor intensive, and frequently hazardous to operate.

Most bulk containers are so large that a single person cannot secure the bulk container to the fill system without moving from one side of the fill system to the other. This has presented numerous difficulties in positioning the flexible bulk container for utilization with the fill system. One prior attempt to alleviate this problem has been the use of a moving work bridge that allows an operator to go from one side of the fill system to the other without walking on the moving conveyor belts often used to transport the filled containers. Other prior efforts include the use of two employees, one on either side of the fill system, to secure the container. Obviously, the latter fill system doubles the labor costs involved with its operation.

Other prior fill systems have required operators to undertake dangerous acrobatic and gymnastic maneuvers in order to secure the container by either having the operator walk on a moving conveyor belt or hang from the fill system by one arm in an attempt to reach over to the other side of the system to secure the bag. Such efforts can lead to employee injuries and other adverse consequences.

The container fill system of the present invention eliminates the foregoing and other problems associated with the prior art by incorporating a rotatable holder in the fill system for securing the flexible bulk containers. The present invention is truly a one person container fill system for flexible bulk containers. It eliminates the need for moving work bridges, walking on moving conveyor belts, and the necessity for performing gymnastic exercises. Additionally, the present invention eliminates the need for additional workers resulting in a savings in labor costs.

The present invention allows a single worker to secure one side of the bulk container to the fill system, rotate the container 180° degrees, and subsequently secure the other side of the container to the system. The bulk container is then filled and thereafter removed by conventional means such as a pallet and fork lift or a moving conveyor belt. Afterwards, the rotatable holder of the container fill system is reversed to position the next bulk container for filling. Thus, the present invention overcomes many of the difficulties inherent in prior container fill systems.

SUMMARY OF THE INVENTION

The present invention relates to an improved container fill system for flexible bulk containers having lift straps. The container fill system generally comprises a support frame with first and second ends; a scale connected to the first end of the support frame for determining the weight of each flexible bulk container and its contents; and a fill control device, such as a slide gate valve having a plurality of adjustable predetermined settings for determining the flow rate of the product, i.e., bulk items such as chemicals, grains and other foodstuffs, into the flexible container. The fill control device is mounted on the second end of the support frame. Additionally, there is a rotatable holder, connected to the support frame, for holding individual flexible bulk containers. The rotatable holder rotates about a vertical axis and comprises, in the preferred embodiment, an H-frame supported on a plurality of V-groove wheels and having a plurality of moveable hooks and rubber fingers connected to the H-frame for holding the flexible bulk containers.

Flexible bulk containers, as exemplified by U.S. Pat. Nos. 4,143,796 and 4,194,652, normally have a plurality of lift straps or like elements which are secured to the container fill system by the hooks of the rotatable holder. After one set of lift straps is secured to the rotatable holder, it is rotated approximately 180° after which the other lift straps of the flexible bulk container are secured.

The container fill system of the present invention also has a fill spout connected to the fill control device and the rotatable holder which provides a passageway for the flow of product into the flexible bulk container supported on the rotatable holder. Additionally, there is a control system for controlling the operation of the container fill system. The control system is secured at the front side of the support frame of the container fill system and comprises a conventional electronic control panel and an associated microprocessor.

The present invention eliminates the need for additional labor, moving work bridges and provides a safer work environment. The container fill system of the present invention also increases the efficiency of operation and thus is both a cost saving and labor saving device. The present invention, therefore, has numerous advantages of the prior art.

BRIEF DESCRIPTION OF THE DRAWINGS

A more complete understanding of the invention may be had by reference to the following Detailed Description when taken in conjunction with the accompanying drawings, in which.

DETAILED DESCRIPTION OF THE INVENTION

Figure 1:
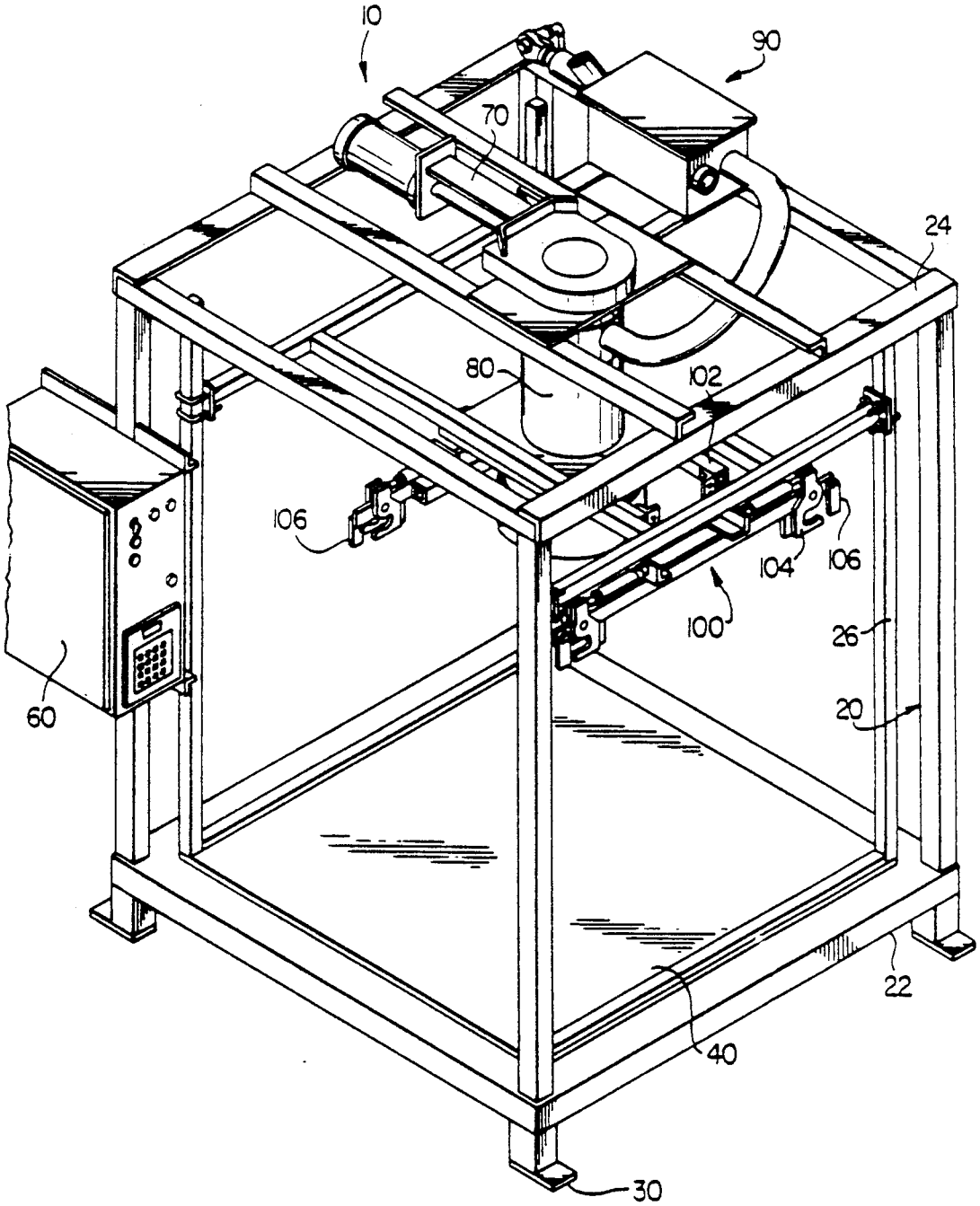
FIG. 1 is a view of the container fill system in a start-up position.

Referring to FIG. 1, the container fill system 10 has a structural support frame 20 with first and second ends, 22 and 24, respectively, for supporting the other elements of the container fill system 10. A plurality of feet 30 form a base for the support frame 20. The support frame 20 may be made of any suitable material as long as it is capable of supporting the weight of the container fill system and a filled flexible bulk container. Preferably, however, the structural support frame 20 is welded structural steel tubing having a Food and Drug Administration food grade enamel finish.

Connected to the first end 22 of the support frame 20, is a scale 40 which weighs the flexible bulk containers (shown in FIGS. 6 and 7), before, during and after filling, in order to determine the weight of product placed in each bulk container. In the preferred embodiment of the invention the scale 40 contains four (4) load cells arranged symmetrically for high accuracy. Additionally, first end 22 of the support frame 20 protects the scale 40 from damage while at the same time allowing the transducer load cells to be changed without dismantling the scale 40. Preferably, the scale 40 interfaces with a conventional weighmeter, such as a HARDY weighmeter having a plurality of predetermined set points and an RS232 output. Such weighmeters are well known in the art.

The scale 40 and other components of the fill container system 10 are operated by the control means 60 attached to the support frame 20. Control means 60 is of any conventional electronic type, and has an associated microprocessor.

A fill control device 70 is mounted on the second end 24 of the support frame 20. The fill control device 70 determines the rate of product flow into the flexible bulk containers. Although any conventional fill control device 70 may be used, the fill control device is preferably a slide gate valve having a plurality of predetermined set positions which are adjusted by the control means 60. Normally the fill control device 70 closes if either pneumatic pressure or control power is lost, thus preventing the flow of product into the bulk container.

Figure 3:
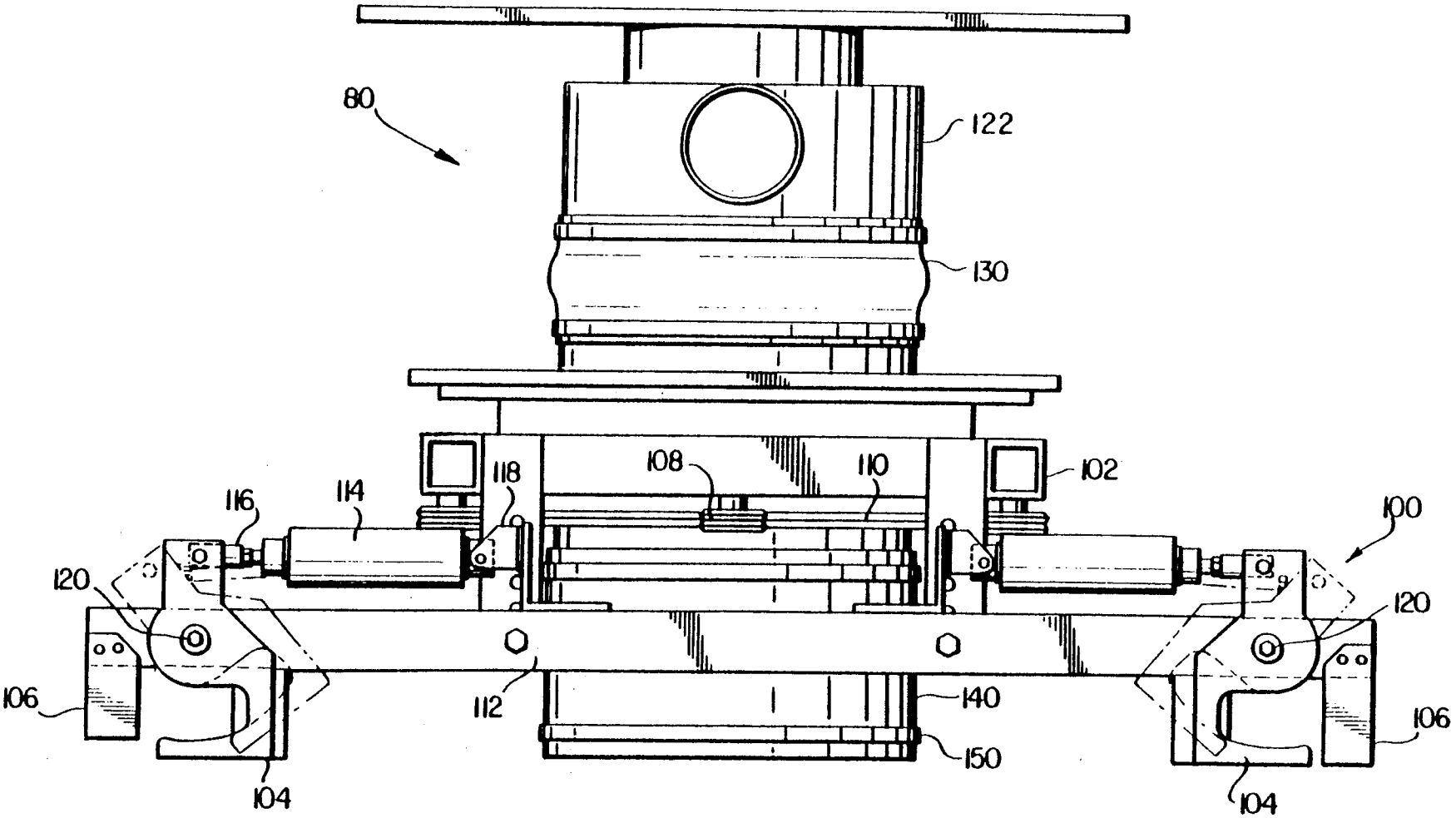
FIG. 3 is a detail view of the rotatable holder and fill spout of the container fill system.
Figure 4:
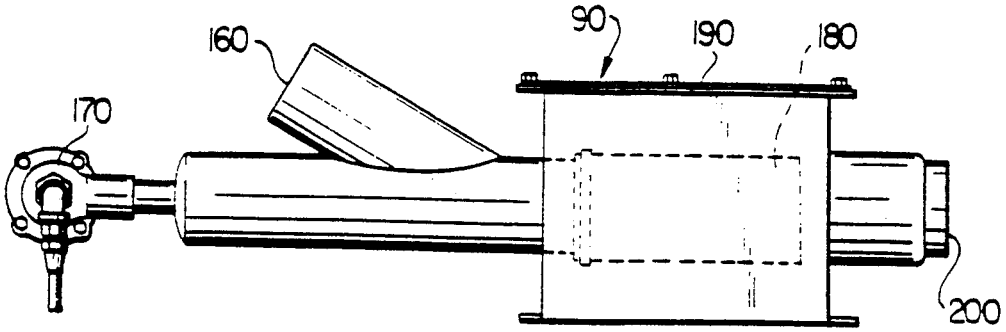
FIG. 4 is a perspective view of the air valve system of the container fill system.
Figure 5:
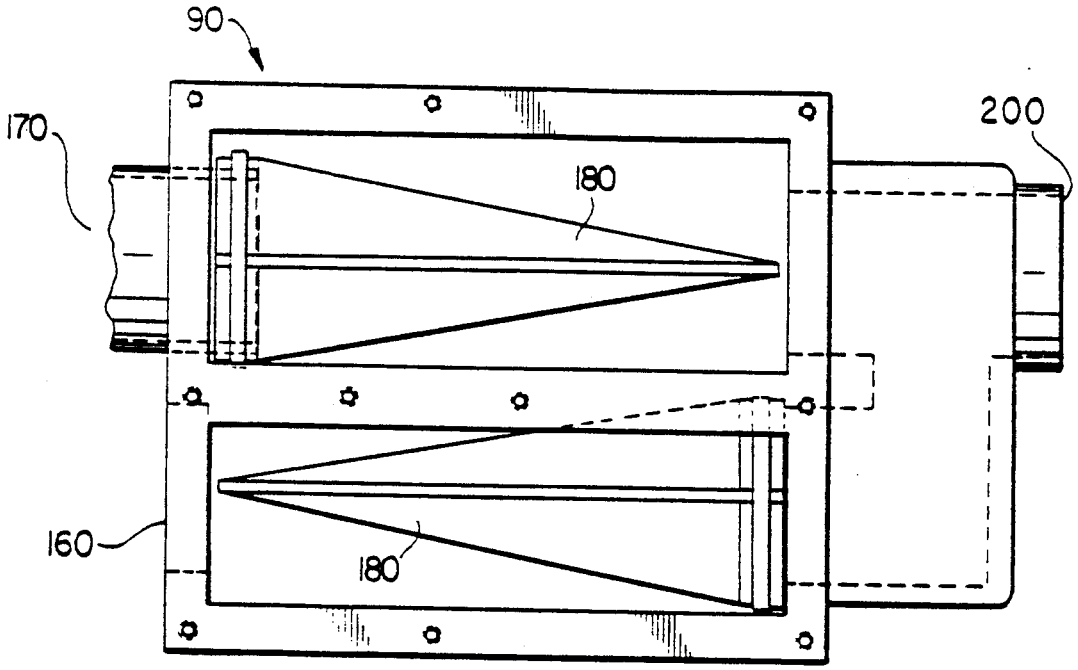
FIG. 5 is an illustration of the interior of the air valve system of FIG. 4.
Figure 6:
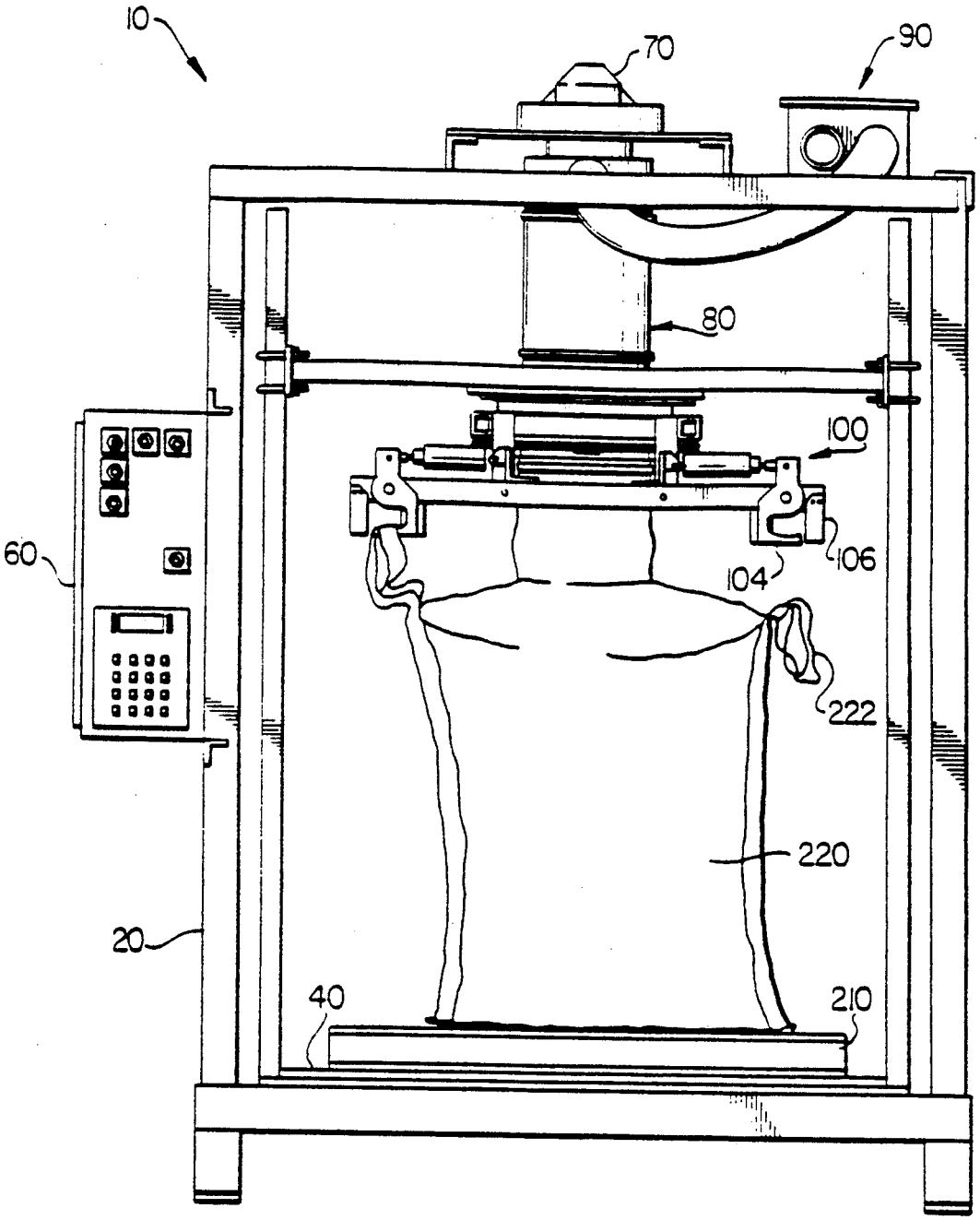
FIG. 6 is a view of the container fill system of FIG. 1 in operation illustrating the attachment of a flexible bulk container to the rotatable holder.

Attached to the fill control device 70 is a fill spout 80 which provides a passageway for the flow of product into the flexible bulk container when the container fill system 10 is in use. As shown in FIGS. 3 and 6, preferably the fill spout 80 has an outer fill spout 122 supported by the scale 40 and an inner fill spout 124 supported by the frame 20 so that tension from the flexible bulk container, as it is being filled, does not affect the scale's accuracy.

Referring to FIGS. 1 and 3, the outer fill spout is covered by a rubber expander tube 140 which expands during operation to form a dust-tight seal with the flexible bulk container. There is also a concentric space between the inner and outer fill spouts that allows air to pass both into the flexible bulk container for inflation and out of the bulk container for dust control.

Also mounted on the second end 24 of the support frame 20 is an air valve system 90 that provides air to inflate the flexible bulk container before filling and vents air from the bulk container during filling. The vented air returns through the air valve system 90 and subsequently flows into a conventional dust collector (not shown). In the described embodiment, the air mixture utilized for inflating the bulk container is a 30% compressed air and 70% room air mixture introduced through the air valve system 90, although a conventional blower could be utilized. The requirements for the air valve system 90 are 80 PSI in the compressed air line which is the necessary pressure to induce 200 CFM for 6 to 15 seconds during the inflation cycle.

Again referring to FIGS. 1 and 3, attached to the fill spout 80 and the support frame 20, through a series of vertical members 26, is the rotatable holder 100. The rotatable holder 100 has an H-frame 102 that is supported on a plurality of V-groove wheels 108 and has a plurality of moveable hooks 104 and rubber fingers 106 that are utilized for securing the flexible bulk containers. The hooks 104 could also face the opposite direction from that shown without any loss of function. The V-groove wheels 108 run on a set of matching concentric rings 110 in the fill spout 80.

The rotatable holder 100, in the preferred embodiment, only rotates 180° degrees about a vertical axis per fill cycle, thus eliminating the need for a conventional slip ring and thereby decreasing the cost of manufacturing the container fill system. The rotatable holder 100 is capable, however, of rotating 360° degrees about a vertical axis if conventional slip ring technology is utilized.

Figure 2:
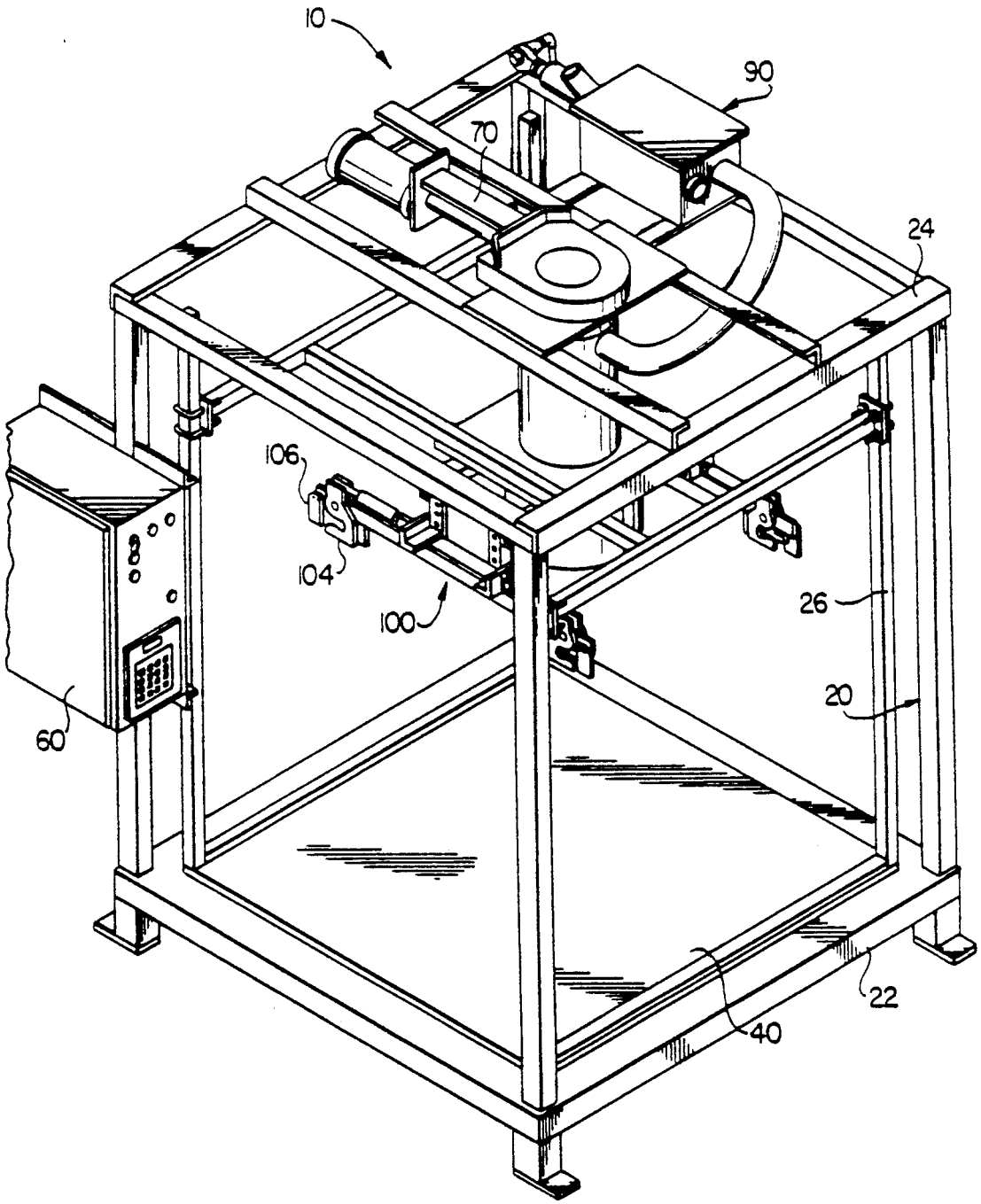
FIG. 2 is a view of the container fill system of FIG. 1 illustrating the rotation of the rotatable holder.

Turning to FIG. 2, the rotatable holder 100 is shown rotated approximately 90° about a vertical axis in relation to its position shown in FIG. 1. When the rotatable holder 100 has rotated approximately 180° degrees, the opposite pair of hooks 104 will be facing the control means 60 and positioned for securement to the other side of the flexible bulk container.

FIG. 3 is a detailed view of the rotatable holder 100 and fill spout 80. The H-frame 102 of the rotatable holder 100 is supported by a plurality of V-groove wheels 108 that run on matching concentric rings 110 located on the fill spout 80. The hooks 104 have a hook support frame 112 with pneumatic cylinder 114 and pivot rod 116 that attach to the hook support frame 112 by means of a pivot mounting bracket 118. The cylinder 114, pivot rod 116 and pivot mounting bracket 118 allow the hook 104 to pivot around a point 120 to release the flexible bulk container when filled. The rubber fingers 106 prevent the lift straps of the flexible bulk container from sliding off of the hooks 104.

Also disclosed in FIG. 3 is the outer fill spout 122 of the fill spout 80 and its fabric connector 130 and rubber expander tube 140. The rubber expander tube 140 expands to form a dust tight seal with the flexible bulk container during filling and deflates to allow removal of the container after filling.

A conventional clamp 150 is used to secure the expander tube 140. Other conventional securing devices could easily be used in lieu of clamp 150.

Turning to FIGS. 1, 3, 4 and 5, the air valve system 90 of the present invention is shown. The air valve system 90 is connected to a conventional dust collector (not shown) through opening 160. An air supply valve 170 and pneumatic cylinders are utilized to provide compressed air to the air valve system 90. The valves 180 are housed within a stainless steel container 190. The valves 180 are arranged in an inverse relation to one another, which allows the valve system 90 to pull the necessary vacuum when supplying air through opening 200 to the fill spout 80 through the conduit connecting the fill spout 80 to the value system 90, and hence to the flexible bulk container for inflation purposes and for venting air through outlet 160 to the dust collector during filling.

Although the air valve system 90 of the present invention in its preferred embodiment has been described in detail, other conventional air valve systems well known in the industry may be utilized with the present invention.

Turning to FIG. 6 therein is shown the container fill system 10 of the present invention in use. A pallet 210 is set on the scale 40 to support the flexible bulk container 220. The container fill system 10 is, however, also capable of being used with a moving conveyor belt system as well as other loading systems. Although any flexible bulk container 220 may be utilized with the present invention, the preferred flexible bulk container has a plurality of lift straps 222 or other like elements for attachment to the hooks 104 of the rotatable holder 100.

In FIG. 6 the lift straps 222 of the flexible bulk container 220 are shown attached to the hooks 104 of the rotatable holder 100 prior to rotation of the rotatable holder 100.

Figure 7:
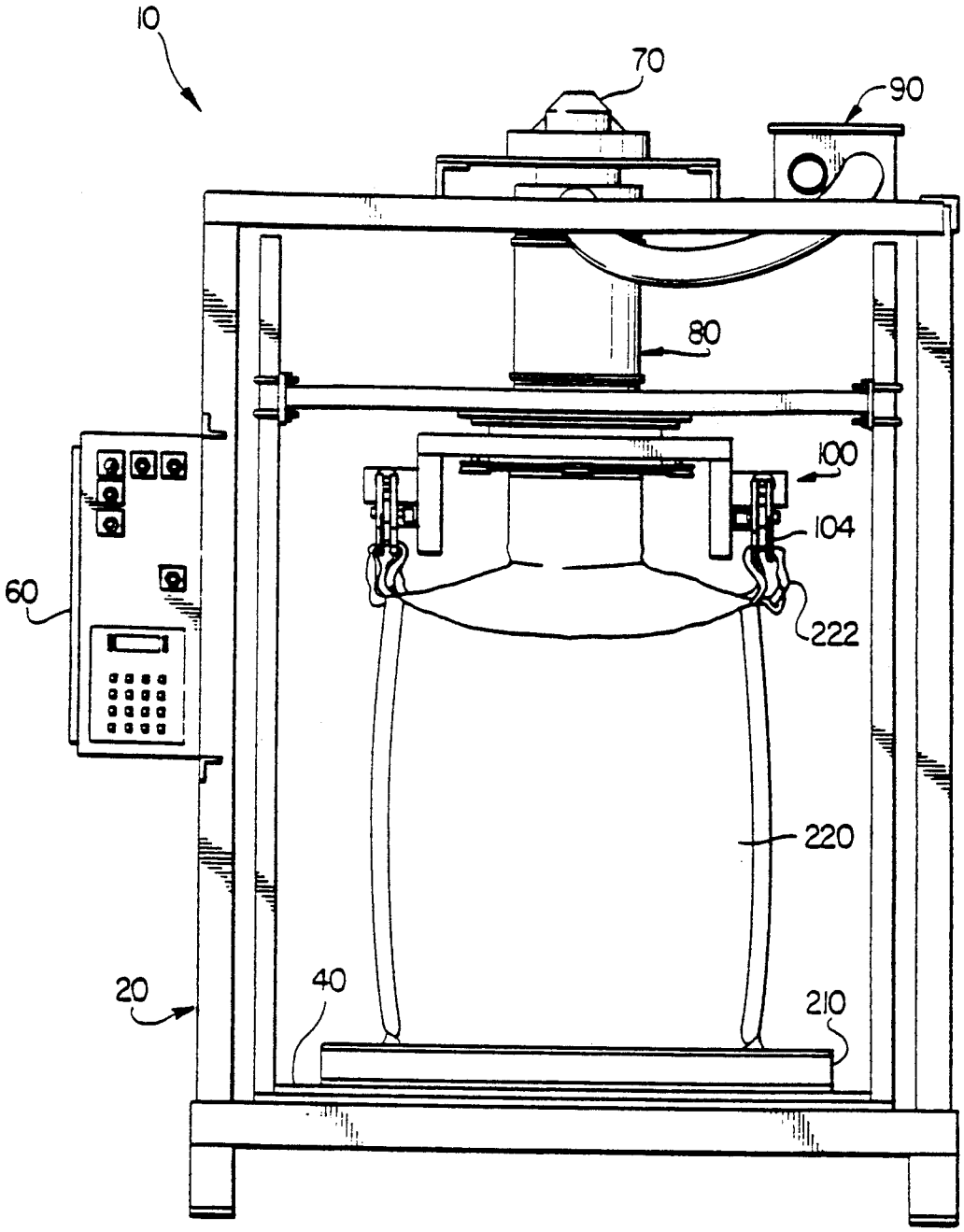
FIG. 7 is a view of the container fill system of FIG. 1 illustrating an inflated flexible bulk container; and, FIG. 8 is an isolated view of the control means utilized during operation of the container fill system.

FIG. 7 shows the flexible bulk container 220 after it has been completely secured to the fill container system 10. In FIG. 7, the rotatable holder 100 has rotated 90° degrees. After the rotatable holder has rotated 180° the remaining two lift straps 222 are attached to the hooks 104. The air valve system 90 has inflated the flexible bulk container 220 after its attachment to the fill spout 80 and expander tube 140 in order to assist with the filling process. The flexible bulk container 220 is subsequently filled with product.

Figure 8:
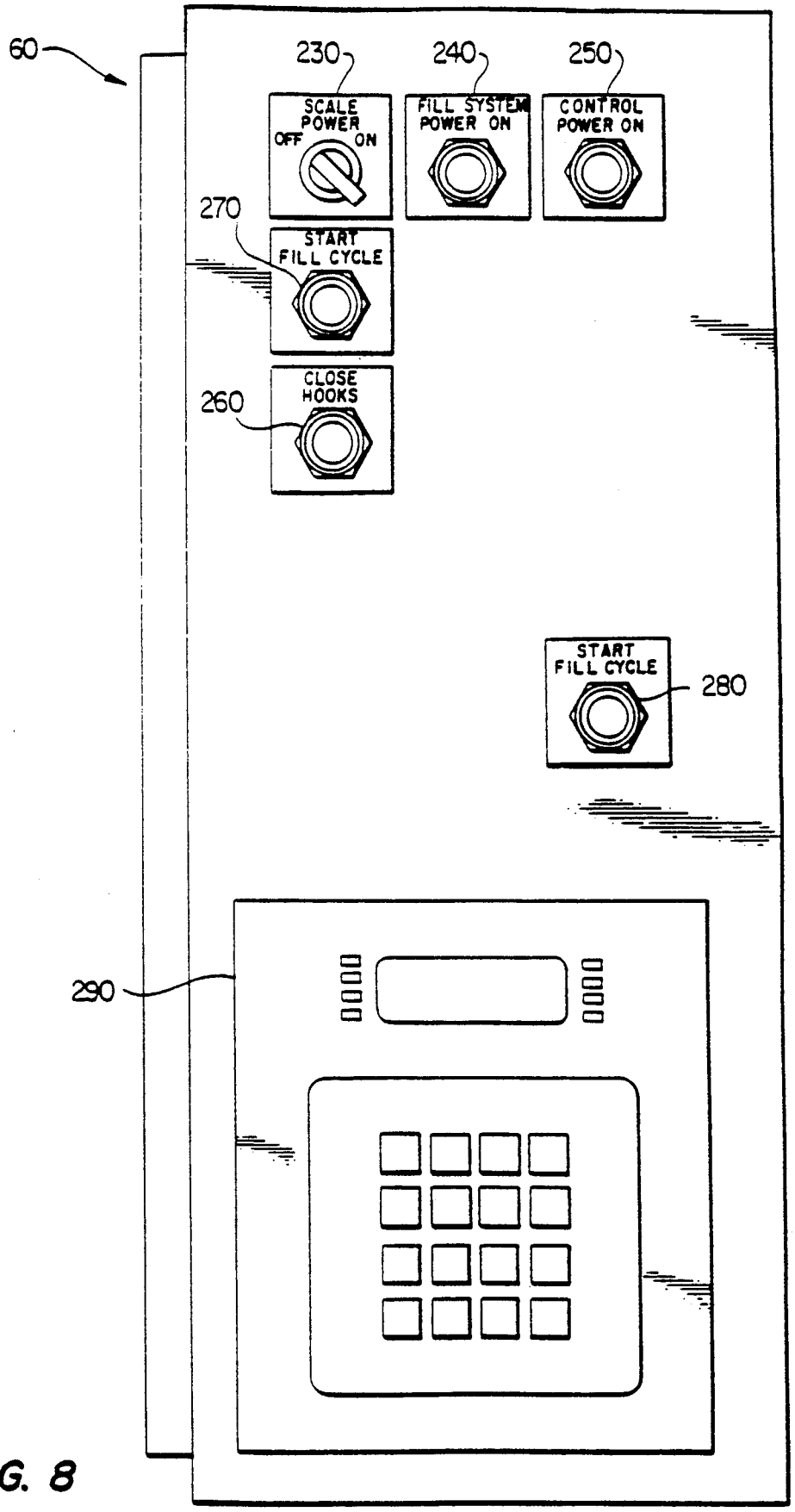

FIGS. 6, 7 and 8 taken together illustrate the operation of the present invention. The scale power switch 230 and control power "ON" button 250 of FIG. 8 are pushed or turned to the "ON" position running on the fill system power "ON" light 240. A pallet 210 is placed on the scale 40 of the container fill system 10, as shown in FIG. 6. The close hook button 260 (FIG. 8) is pushed and the straps 222 are threaded onto the hooks 104 (FIG. 6). At this time, the rotatable holder 100 is rotated 180° degrees about a vertical axis. Rotation may be accomplished either manually or by means of conventional electronic apparatus.

The remaining straps 222 are threaded over the other hooks 104 (FIG. 7). Subsequently, the flexible bulk container 220 is placed onto the fill spout 80 and expander tube 140. The expander tube 140 is inflated by pressing an inflate push button (not shown), preferably located near the fill spout 80. After the expander tube 140 is expanded, pushing the dual start/fill cycle buttons 270 and 280 (FIG. 8) will start an automatic operating sequence.

Subsequently, the scale 40 automatically tares, with the weight being displayed on the LED panel 290 of the control means 60 (FIG. 8) and the flexible container inflates by means of the air valve system 90 (FIG. 7). At this time, the fill control device 70 automatically engages and moves to the full open or retracted position above the fill spout 80 opening. As the flexible bulk container fills the fill control device 70 will automatically move to the dribble flow setting, controlled by the scale 40. The stop fill operation is automatically controlled by the scale 40 and once the flexible bulk container 220 is filled to the appropriate level and weight, the expander tube 140 deflates and the hooks 104 automatically open, releasing tension on the filled flexible bulk container 220. At this time, an employee closes the top of the filled flexible bulk container 220, and the container 220 is removed from the pallet 210 by means of a fork lift. Alternately, if a moving conveyor belt is utilized, the container is removed by the conveyor belt. The system 10 is then ready for loading and filling of the next flexible bulk container 220.

It will be apparent to those skilled in the art that various changes may be made without departing from the scope of the invention, and the invention is not to be considered limited to what is described in the specification.

I claim:

1. A container fill system for filling flexible bulk containers having lift straps with a product comprising:

a support frame having first and second ends;

a scale connected to the first end of the support frame for determining the weight of the flexible bulk containers;

a fill control device mounted on the second end of the support frame for controlling the flow rate of product into the flexible bulk containers;

a rotatable holder connected to the support frame for supporting the flexible bulk container therefrom for rotation about a vertical axis;

attachment means for securing the lift straps to the rotatable holder for supporting the flexible bulk containers; and a fill spout connected to the fill control device and the rotatable holder for providing a passageway for the flow of product into the flexible bulk containers.

2. A container fill system for flexible bulk containers in accordance with claim 1 further comprising:

an air valve system attached to the second end of the support frame and connected to the fill spout for inflating the flexible bulk containers and for venting air from the flexible bulk containers during filling.

3. A container fill system for flexible bulk containers in accordance with claim 1 wherein the support frame further comprises welded metal tubing.

4. A container fill system for flexible bulk containers in accordance with claim 1 wherein the fill control device further comprises a slide gate valve having a plurality of adjustable predetermined settings for adjusting the flow rate of product into the flexible bulk containers.

5. A container fill system for flexible bulk containers in accordance with claim 1 wherein the rotatable holder further comprises an H-frame supported on a plurality of V-groove wheels and having a plurality of moveable hooks and rubber fingers connected to the H-frame for securing the lift straps to the rotatable holder for supporting the flexible bulk containers.

6. A container fill system for flexible bulk containers in accordance with claim 5 wherein the rotatable holder is capable of rotating a suspended flexible bulk container 180 degrees about the vertical axis.

7. A container fill system for flexible bulk containers in accordance with claim 5 wherein the fill spout further includes a plurality of matching concentric rings about which the V-groove wheels of the rotatable holder travel.

8. A container fill system for flexible bulk containers in accordance with claim 1 wherein the fill spout further comprises inner and outer fill spouts wherein the inner fill spout is supported by the support frame and the outer fill spout is supported by the scale.

9. A container fill system for flexible bulk containers in accordance with claim 8 wherein the outer fill spout further comprises a rubber expander tube that when inflated forms a dust-tight seal with the flexible bulk containers.

10. A container fill system for filling with a product flexible bulk containers having lift straps comprising:

a support frame having first and second ends;

a scale connected to the first end of the support frame for determining the weight of the flexible bulk containers;

a fill control device mounted on the second end of the support frame for controlling the flow rate of product into the flexible bulk containers;

a rotatable holder connected to the support frame for supporting the flexible bulk container therefrom for rotation about a vertical axis;

attachment means for securing the lift straps to the rotatable holder for supporting the flexible bulk containers;

a fill spout connected to the fill control device and the rotatable holder for providing a passageway for the flow of product into the flexible bulk containers; and an air valve system attached to the second end of the support frame and connected to the fill spout for inflating the flexible bulk containers and for venting air from the flexible bulk containers during filling.

11. A container fill system for flexible bulk containers in accordance with claim 10 wherein the fill control device further comprises a slide gate valve having a plurality of adjustable predetermined settings for adjusting the flow rate of product into the flexible bulk containers.

12. A container fill system for flexible bulk containers in accordance with claim 10 wherein the rotatable holder further comprises an H-frame supported on a plurality of V-groove wheels and having a plurality of moveable hooks and rubber fingers connected to the H-frame for securing the lift straps to the rotatable holder for supporting the flexible bulk containers.

13. A container fill system for flexible bulk containers in accordance with claim 10 wherein the rotatable holder is capable of rotating 180 degrees about the vertical axis to allow attachment or removal of the lift straps on opposed sides of the rotatable holder while standing on one side of the system by rotating the holder 180 degrees about the vertical axis after attaching or removing the straps from one side of the rotatable holder to position the opposed side of the rotatable holder for attachment or removal of the remaining straps.

14. A container fill system for flexible bulk containers in accordance with claim 10 wherein the fill spout further comprises inner and outer fill spouts with the inner fill spout supported by the support frame and the outer fill spout supported by the scale.

15. A container fill system for filling flexible bulk containers having lift straps with a product comprising:

a support frame having first and second ends;

a scale connected to the first end of the support frame for determining the weight of the flexible bulk containers;

a slide gate valve mounted on the second end of the support frame with a plurality of adjustable predetermined settings for controlling the flow rate of product into the flexible bulk containers;

a rotatable holder connected to the support frame for supporting the flexible bulk container therefrom for rotation about a vertical axis and having an H-frame supported on a plurality of V-groove wheels and having a plurality of moveable hooks and rubber fingers connected to the H-frame for securing the lift straps to the rotatable holder for supporting the flexible bulk containers;

a fill spout connected to the slide gate valve and the rotatable holder for providing a passageway for the flow of product into the flexible bulk container having an inner fill spout and an outer fill spout with the inner fill spout supported by the support frame and the outer fill spout supported by the scale and wherein the outer fill spout has a plurality of matching concentric rings about which the V-groove wheels of the rotatable holder travel; and valve system mounted on the second end of the support frame and connected to the fill spout for inflating the flexible bulk containers and for venting air from the flexible bulk containers during filling.

16. A container fill system for flexible bulk containers in accordance with claim 15 wherein the support frame further comprises welded metal tubing.

17. A container fill system for flexible bulk containers in accordance with claim 15 wherein the rotatable holder is capable of rotating 180 degrees about the vertical axis to allow attachment or removal of the lift straps on opposed sides of the rotatable holder while standing on one side of the system by rotating the holder 180 degrees about the vertical axis after attaching or removing the straps from one side of the rotatable holder to position the opposed side of the rotatable holder for attachment or removal of the remaining straps.

18. A container fill system for flexible bulk containers in accordance with claim 15 wherein the outer fill spout further comprises a rubber expander tube that when inflated forms a dust-tight seal with the flexible bulk container.

* * * * *